US006483502B2

(12) United States Patent
Fujiwara

(10) Patent No.: US 6,483,502 B2
(45) **Date of Patent: *Nov. 19, 2002**

(54) IMAGE REPRODUCING APPARATUS, PROJECTOR, IMAGE REPRODUCING SYSTEM, AND INFORMATION STORING MEDIUM

(75) Inventor: Shuichi Fujiwara, Hotaka-machi (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/101,328

(22) PCT Filed: Nov. 6, 1997

(86) PCT No.: PCT/JP97/04039

§ 371 (c)(1),
(2), (4) Date: Jul. 7, 1998

(87) PCT Pub. No.: WO98/20476

PCT Pub. Date: May 14, 1998

(65) Prior Publication Data

US 2002/0039097 A1 Apr. 4, 2002

(30) Foreign Application Priority Data

Nov. 7, 1996 (JP) ..... 8-312769

(51) Int. Cl.[7] ..... G09G 5/00
(52) U.S. Cl. ..... 345/213; 345/3.4
(58) Field of Search ..... 345/213, 99, 132, 345/96, 3, 190, 204–212, 698, 699, 3.1, 3.2, 3.3, 3.4; 348/537, 790, 792

(56) References Cited

U.S. PATENT DOCUMENTS

| | | | | | |
|---|---|---|---|---|---|
| 5,396,593 | A | * | 3/1995 | Mori et al. | 345/501 |
| 5,731,843 | A | * | 3/1998 | Cappels, Sr. | 348/537 |
| 5,790,110 | A | * | 8/1998 | Baker et al. | 345/547 |
| 5,801,767 | A | * | 9/1998 | Wu | 348/190 |
| 5,841,430 | A | * | 11/1998 | Kurikko | 345/213 |
| 5,903,253 | A | * | 5/1999 | Mizutome et al. | 345/132 |
| 6,046,737 | A | * | 4/2000 | Nakamura | 345/213 |

FOREIGN PATENT DOCUMENTS

| | | |
|---|---|---|
| JP | A-1-221798 | 9/1989 |
| JP | A-3-163586 | 7/1991 |
| JP | A-5-341750 | 12/1993 |
| JP | A-6-161369 | 6/1994 |

* cited by examiner

*Primary Examiner*—Steven Saras
*Assistant Examiner*—Amr Awad
(74) *Attorney, Agent, or Firm*—Oliff & Berridge, PLC

(57) ABSTRACT

A liquid crystal projector is provided which automatically sets optimal sample parameters based on input analog image signals, capable of accurately performing image reproduction. The liquid crystal projector stores judging data formed by weighting and grouping the display modes using horizontal scanning data of analog image signals, vertical scanning data, and synchronizing signal polarity data. Then, the input horizontal scanning data, vertical scanning data, and synchronizing signal polarity data are detected by a judging condition detecting unit, and the display mode of the input analog image signals is automatically identified based on these detection results and the grouped judging data. Then, the sampling parameters are automatically set, based on the judging results.

23 Claims, 12 Drawing Sheets

| DISPLAY MODE | SYSTEM | V S C | H S C |
|---|---|---|---|
| USL | | 320 | 12800 |
| EGA | EGA | 366 | 12270 |
| PC 98 | PC 98 | 440 | 10810 |
| VESA 75 | VGA | 500 | 7160 |
| VESA 72 | VGA | 520 | 7080 |
| MAC 13 | VGA | 525 | 7670 |
| VGA 60 | VGA | 525 | 8530 |
| SVGA 75 | SVGA | 625 | 5710 |
| SVGA 56 | SVGA | 625 | 7620 |
| SVGA 60 | SVGA | 628 | 7080 |
| SVGA 72 | SVGA | 666 | 5580 |
| MAC 16 | SVGA | 667 | 5390 |
| XGA 60 | XGA | 806 | 5550 |
| US H | | 832 | 5120 |

| DISPLAY MODE | SYSTEM | V S C | H S C |
|---|---|---|---|
| USL | | 320 | 12800 |
| EGA | EGA | 366 | 12270 |
| PC 98 | PC 98 | 440 | 10810 |
| VESA 75 | VGA | 500 | 7160 |
| VESA 72 | VGA | 520 | 7080 |
| MAC 13 | VGA | 525 | 7670 |
| VGA 60 | VGA | 525 | 8530 |
| SVGA 75 | SVGA | 625 | 5710 |
| SVGA 56 | SVGA | 625 | 7620 |
| SVGA 60 | SVGA | 628 | 7080 |
| SVGA 72 | SVGA | 666 | 5580 |
| MAC 16 | SVGA | 667 | 5390 |
| XGA 60 | XGA | 806 | 5550 |
| US H | | 832 | 5120 |

FIG. 7

EGA/PC98 GROUP

| DISPLAY MODE | SYSTEM | V S C | H S C |
|---|---|---|---|
| EGA | EGA | 366 | 12270 |
| PC 98 | PC98 | 440 | 10810 |

FIG. 8A

SVGA GROUP

| DISPLAY MODE | SYSTEM | V S C | H S C |
|---|---|---|---|
| SVGA 75 | SVGA | 625 | 5710 |
| SVGA 56 | SVGA | 625 | 7620 |
| SVGA 60 | SVGA | 628 | 7080 |
| SVGA 72 | SVGA | 666 | 5580 |
| MAC 16 | SVGA | 667 | 5590 |

FIG. 8B

VGA GROUP

| DISPLAY MODE | SYSTEM | V S C | H S C |
|---|---|---|---|
| VESA 75 | VGA | 500 | 7160 |
| VESA 72 | VGA | 520 | 7080 |
| MAC 13 | VGA | 525 | 7670 |
| VGA 60 | VGA | 525 | 8530 |

FIG. 8C

XGA GROUP

| DISPLAY MODE | SYSTEM | V S C | H S C |
|---|---|---|---|
| XGA 60 | XGA | 806 | 5550 |

FIG. 8D

VALUE OF SY

| DISPLAY MODE | SY | | | |
|---|---|---|---|---|
| | H S | V S | H P | V P |
| VGA | 1 | 1 | 1 | 1 |
| VESA 72 | 1 | 1 | 1 | 1 |
| VESA 75 | 1 | 1 | 1 | 1 |
| MAC 13 | 1 | 0 | 1 | 0 |
| SVGA 56 | 1 | 1 | 0 | 0 |
| SVGA 60 | 1 | 1 | 0 | 0 |
| SVGA 72 | 1 | 1 | 0 | 0 |
| SVGA 75 | 1 | 1 | 0 | 0 |
| XGA | 1 | 1 | 1 | 1 |
| EGA | 1 | 1 | 0 | 1 |
| MAC 16 | 1 | 0 | 1 | 0 |
| PC 98 | 1 | 1 | 1 | 1 |

FIG. 9

| DISPLAY MODE | RESOLUTION | SYSTEM (GROUP) | VSC | HSC | |
|---|---|---|---|---|---|
| USL | | | 320 | 12800 | |
| EGA | 640 * 350 | EGA/PC98 | 366 | 12270 | EGA/PC98 GROUP |
| PC98 | 640 * 400 | EGA/PC98 | 440 | 10810 | |
| VESA85 | 640 * 480 | VGA | 509 | 6190 | VGA GROUP |
| VESA75 | 640 * 480 | VGA | 500 | 7160 | |
| VESA72 | 640 * 480 | VGA | 520 | 7080 | |
| Mac13 | 640 * 480 | VGA | 525 | 7670 | |
| VGA60 | 640 * 480 | VGA | 525 | 8530 | |
| SVGA85 | 800 * 600 | SVGA | 631 | 5000 | SVGA GROUP |
| SVGA75 | 800 * 600 | SVGA | 625 | 5710 | |
| SVGA72 | 800 * 600 | SVGA | 666 | 5580 | |
| SVGA60 | 800 * 600 | SVGA | 628 | 7080 | |
| SVGA56 | 800 * 600 | SVGA | 625 | 7620 | |
| Mac16 | 832 * 624 | SVGA | 667 | 5390 | |
| XGA85 | 1024 * 768 | XGA | 808 | 4000 | XGA GROUP |
| XGA75 | 1024 * 768 | XGA | 800 | 4480 | |
| XGA70 | 1024 * 768 | XGA | 806 | 4760 | |
| XGA60 | 1024 * 768 | XGA | 806 | 5550 | |
| Mac19 | 1024 * 768 | XGA | 804 | 4450 | |
| EWS75 | 1152 * 864 | SXGA | 900 | 3970 | SXGA GROUP |
| Mac21 | 1152 * 870 | SXGA | 915 | 3900 | |
| EWS85 | 1280 * 960 | SXGA | 1011 | 3120 | |
| EWS60 | 1280 * 960 | SXGA | 1000 | 4470 | |
| SXGA85 | 1280 * 1024 | SXGA | 1072 | 2950 | |
| SXGA75 | 1280 * 1024 | SXGA | 1066 | 3350 | |
| SXGA60 | 1280 * 1024 | SXGA | 1066 | 4190 | |
| US H | | | 1150 | 2500 | |
| | | | | | |

FIG. 11

VALUE OF SY

| DISPLAY MODE | RESOLUTION | SY | | | |
|---|---|---|---|---|---|
| | | H S | V S | H P | V P |
| EGA | 640 * 350 | 1 | 1 | 0 | 1 |
| PC 98 | 640 * 400 | 1 | 1 | 1 | 1 |
| VESA 85 | 640 * 480 | 1 | 1 | 1 | 1 |
| VESA 75 | 640 * 480 | 1 | 1 | 1 | 1 |
| VESA 72 | 640 * 480 | 1 | 1 | 1 | 1 |
| Mac 13 | 640 * 480 | 1 | 0 | 1 | 0 |
| VGA 60 | 640 * 480 | 1 | 1 | 1 | 1 |
| SVGA 85 | 800 * 600 | 1 | 1 | 0 | 0 |
| SVGA 75 | 800 * 600 | 1 | 1 | 0 | 0 |
| SVGA 72 | 800 * 600 | 1 | 1 | 0 | 0 |
| SVGA 60 | 800 * 600 | 1 | 1 | 0 | 0 |
| SVGA 56 | 800 * 600 | 1 | 1 | 0 | 0 |
| Mac 16 | 832 * 624 | 1 | 0 | 1 | 0 |
| XGA 85 | 1024 * 768 | 1 | 1 | 0 | 0 |
| XGA 75 | 1024 * 768 | 1 | 1 | 0 | 0 |
| XGA 70 | 1024 * 768 | 1 | 1 | 1 | 1 |
| XGA 60 | 1024 * 768 | 1 | 1 | 1 | 1 |
| Mac 19 | 1024 * 768 | 1 | 0 | 0 | 0 |
| EWS 75 | 1152 * 864 | 1 | 1 | 0 | 0 |
| Mac 21 | 1152 * 870 | 1 | 0 | 0 | 0 |
| EWS 85 | 1280 * 960 | 1 | 1 | 0 | 0 |
| EWS 60 | 1280 * 960 | 1 | 1 | 0 | 0 |
| SXGA 85 | 1280 * 1024 | 1 | 1 | 0 | 0 |
| SXGA 75 | 1280 * 1024 | 1 | 1 | 0 | 0 |
| SXGA 60 | 1280 * 1024 | 1 | 1 | 0 | 0 |
| | | | | | |

FIG. 12

IMAGE REPRODUCING APPARATUS, PROJECTOR, IMAGE REPRODUCING SYSTEM, AND INFORMATION STORING MEDIUM

BACKGROUND OF THE INVENTION

1. Field of Invention

The present invention relates to an image reproducing apparatus, projector, image reproducing system, and information storing medium, and particularly relates to an image reproducing apparatus, projector, image reproducing system, and information storing medium wherein input analog image signals are sampled according to display pixels and reproduced.

2. Description of Related Art

There are known image reproducing apparatuses in which input analog image signals are sampled according to display pixels and reproduced. Examples of such image display apparatuses include projectors using liquid crystal shutters (liquid crystal light valves), liquid crystal displays, plasma displays, and the like.

In order to use such an image reproducing apparatus and to sample and reproduce analog image signals supplied for, e.g., a computer, the input analog image data is subjected to sampling for each pixel of the liquid crystal shutter, liquid crystal display, or plasma display which is being used. How the parameters for sampling of the analog image signals are set at the time of the sampling processing is a crucial factor for good image reproduction.

The reason is that the sampling parameters slightly differ one from another depending on the type of computer supplying the image signals, or the computer manufacturer, even regarding analog image signals belonging to a group called VGA which represents a resolution of 640 by 480 pixels, for example.

For example, a sampling clock is used for sampling in order to create digital data according to each pixel, and when one horizontal scanning period corresponds to an output cycle of 800 pixels, the clock frequency is set such that 800 pulses are output during the one horizontal scanning period. In the event that the frequency of the sampling clock is different, problems arise in which there is a discrepancy between the sampling timing necessary for good image reproduction and the actual sampling timing.

Accordingly, it is important to perform auto-determination of the display mode in an accurate manner based on the input analog image signals, and to perform sampling processing of the signals using optimal sampling parameters.

In order to conduct this automatic determination, conventional apparatuses have employed a system in which tables are prepared beforehand for each display mode for identifying the display mode from the following three types of data: horizontal scanning data (one horizontal scanning period), vertical scanning data (how many vertical scanning lines are scanned per output cycle of vertical synchronous signal), and synchronous signal polarity data (the polarity of horizontal and vertical synchronous signals). Further, the three types of data from the input analog image signals, i.e., the horizontal scanning data, vertical scanning data, and polarity are checked against the aforementioned table, thus identifying the display mode in the event that all three items completely match the criteria.

However, rapid technological advances are being made nowadays, and the resolution of the image signals output from the computer is not limited to the aforementioned VGA. Rather, there are several types such as SVGA (800 by 600 pixels), XGA (1024 by 768), etc., and further, such a plurality of resolutions of analog image signals are often selectively output from the same computer. There are many types of analog image signals of each resolution in which the horizontal or vertical scanning data closely resembles that of analog image signals of another resolution, and moreover, there are many cases in which, for example, the horizontal scanning data is almost the same between VGA analog image signals output from a computer from a Company A and SVGA analog image signals output from a computer from a Company B.

Accordingly, it is difficult to accurately determine the great variety of display modes using the aforementioned known display mode determination means. There are instances in which, for example, a display mode which originally belongs to VGA is incorrectly determined to be a display mode belonging to SVGA, which is entirely different.

Further, the conventional determination method searches a display mode in which the analog image signal's horizontal scanning data, vertical scanning data, and polarity data completely match from the determination table. For example, if the horizontal scanning data or vertical scanning data slightly differ from the data in the determination table, the process becomes permanently trapped in the display mode determination loop process, in which cases the reproduced image is not displayed at all.

In the event that such a condition occurs, the user can deal with the problem by setting the sampling parameters according to the type of computer being used or the display mode. However, users not familiar with the equipment tend to determine the problem as being a malfunction of the display reproducing apparatus, necessitating effective countermeasures.

SUMMARY OF THE INVENTION

The present invention has been made in light of such needs, and accordingly, it is an object of the present invention to provide an image reproducing apparatus, projector, image reproducing system, and information storing medium wherein optimal sampling parameters are automatically set according to input analog image signals, enabling image reproduction in a sure manner.

In order to achieve the above objects, the image reproducing apparatus according to the present invention is an image reproducing apparatus which samples and reproduces input analog image signals in accordance with display pixels. The image reproducing apparatus comprises: automatic determination means for automatically determining a display mode from the analog image signals; and image data generating means. Sampling parameters for sampling and reproducing analog image signals in accordance with display pixels are set for each display mode, and the image data generating means samples the analog image signals in accordance with display pixels, based on the sampling parameters corresponding with the determined display mode. The automatic determination means comprises: storing means for storing determination data which has been formed by weighting and grouping each display mode using the horizontal scanning data of the analog image signals, the vertical scanning data of the analog image signals, and polarity data of the synchronous signals; determination condition detecting means for detecting the input horizontal scanning data and vertical scanning data of the input analog image signals, and polarity data of the synchronous signals; and determination means for determining the display mode of the analog image signals input from the grouped determination data, using at least one of the detected horizontal scanning data and vertical scanning data of the analog image signals, and synchronous signals.

Also, the information storing medium according to the present invention is an information storing medium for an image reproducing apparatus which samples and reproduces input analog image signals in accordance with display pixels, the information storing medium comprises: information for automatically determining a display mode from the analog image signals; and information for sampling and generating image data. Sampling parameters for sampling and reproducing input analog image signals in accordance with display pixels are set for each display mode, and the input analog image signals are scanned and image data is reproduced in accordance with display pixels, based on the sampling parameters corresponding with the determined display mode. The information for automatically determining comprises: information for determining data which has been formed by weighting and grouping each display mode using the horizontal scanning data of the analog image signals, the vertical scanning data of the analog image signals, and polarity data of the synchronous signals; information for detecting the input horizontal scanning data and vertical scanning data of the analog image signals, and polarity data of the synchronous signals; and information for determining the display mode of the analog image signals input from the grouped determination data, using at least one of the detected horizontal scanning data of the analog image signals, vertical scanning data of the analog image signals, and synchronous signals.

Now, the aforementioned analog image signals may be either still image signals or motion image signals. That is to say, the term analog image signals refers to all analog image signals which are the object of display by an image reproducing apparatus. In the present invention, the determination data for determining the display mode is formed by weighting and grouping each display mode using the following data: horizontal scanning data of the analog image signals, vertical scanning data of the analog image signals, and polarity data of the synchronous signals, these being weighted and grouped. For example, the display modes belonging to the resolutions such as VGA, SVGA, XGA and so forth are weighted according to each to the aforementioned determination items, and thus grouped, thereby forming data for determining the display mode.

Accordingly, the first weighted group is identified by at least one of the types of data of the input analog image signals detected by the determination condition detecting means. At this time, in the event that there is only one display mode included in the identified group, this display mode is determined to the be display mode of the analog image signals.

Also, in the event that there is a plurality of display modes included in the identified group, the next weighted display mode is identified based on one of the remaining determination items. At this time, in the event that there is only one display mode identified, this display mode is determined to be the display mode of the analog image signals.

Also, in the event that there is still a plurality of display modes, the final display mode is identified based on the remaining determination item, and, this display mode is determined to the be display mode of the analog image signals.

Thus, an optimal display mode can always be decided upon which satisfies the three conditions, i.e., the horizontal scanning data, vertical scanning data, and polarity data of the input analog image signals, whereby even when there is a great number of options for inputting image signals, automatic determination thereof can be performed is a sure manner and good image reproduction can be performed using optimal sampling parameters.

Particularly, according to the present invention, even in the event that the input analog image signals and the horizontal scanning data, vertical scanning data, and polarity data for determining the data do not completely agree, an optimal display mode can always be selected automatically. Thus, problems such as those in the conventional art wherein the process becomes trapped in the judging loop and image reproduction is not performed can be avoided, thereby achieving an image reproducing apparatus which is extremely user-friendly for beginning users.

Moreover, even when the display mode determined by the present invention is slightly different from the actual display mode, image reproduction is conducted based on sampling parameters close to the original display mode. Thus, the user can set preferable image reproduction states by simply fine-tuning the sampling parameters while observing the displayed image, thereby realizing an extremely easy to use image reproducing apparatus in this aspect, as well.

According to the present invention, the determination data for the display mode is formed by weighting and grouping in the order of: one of the horizontal scanning data and vertical scanning data; the other of the horizontal scanning data and vertical scanning data; and the polarity data.

That is to say, in the case of creating the display mode determination data, it is important how the grouping thereof is performed by weighting the horizontal scanning data, vertical scanning data, and polarity data.

According to the present invention, a display mode grouping configuration has been employed wherein the horizontal scanning data and vertical scanning data, which tend to differ greatly in value from one display mode to another are set as greatly weighted items.

Thus, the optimal display mode can be accurately determined from the input analog image signals.

Particularly, the aforementioned horizontal scanning data and vertical scanning data are obtained as numerical values. Accordingly, even more appropriate display mode determination data can be created by grouping the horizontal scanning data and vertical scanning data as described above.

According to the present invention, the determination data for the display mode is formed by weighting and grouping in the order of: horizontal scanning data; vertical scanning data; and the polarity data.

By means of creating the display mode determination data as described above, the display mode can be even more accurately determined from analog image signals being provided from computers presently commercially available.

According to the present invention, the sampling parameters include a timing control sampling parameter for determining the timing for performing sampling of input analog image signals according to display pixels.

Now, it is preferable that the above timing-related sampling parameters include data and the like for determining the frequency of the timing clock, phase for synchronizing, and image display position.

According to the present invention, the image data generating means samples input analog image signals according to the display pixels of a liquid crystal display, liquid crystal shutter or plasma display.

The liquid crystal projector according to the present invention samples input analog image signals according to the display pixels of a liquid crystal shutter based on the sampling parameters and reproduces the signals as a projector image, using the above-described image reproducing apparatus.

The image reproducing system according to the present invention comprises: a computer device for outputting analog image signals; and the above-described reproducing apparatus, for sampling input analog image signals according to the display pixels of a liquid crystal display, liquid crystal shutter or plasma display, based on usage environment data, and reproducing the signals as a projector image.

BRIEF DESCRIPTION OF DRAWING

FIG. 7 is an explanatory diagram illustrating the display modes supported by the present embodiment;

FIGS. 8A through 8D are explanatory diagrams illustrating a data table of the display modes shown in FIG. 7 grouped according to vertical scanning data;

FIG. 9 is an explanatory diagram illustrating a data table of the display modes shown in FIG. 7 grouped according to the polarity of horizontal and vertical scanning signals;

FIG. 11 is an explanatory diagram illustrating a data table of display modes supported by another embodiment grouped according to vertical scanning data;

FIG. 12 is an explanatory diagram illustrating a data table of the display modes shown in FIG. 11 grouped according to the polarity of horizontal and vertical scanning signals.

DETAILED DESCRIPTION OF THE PREFERRED EMBODIMENT

Next, a preferred embodiment of the present intention will be described with reference to the drawings.

Figure 1:
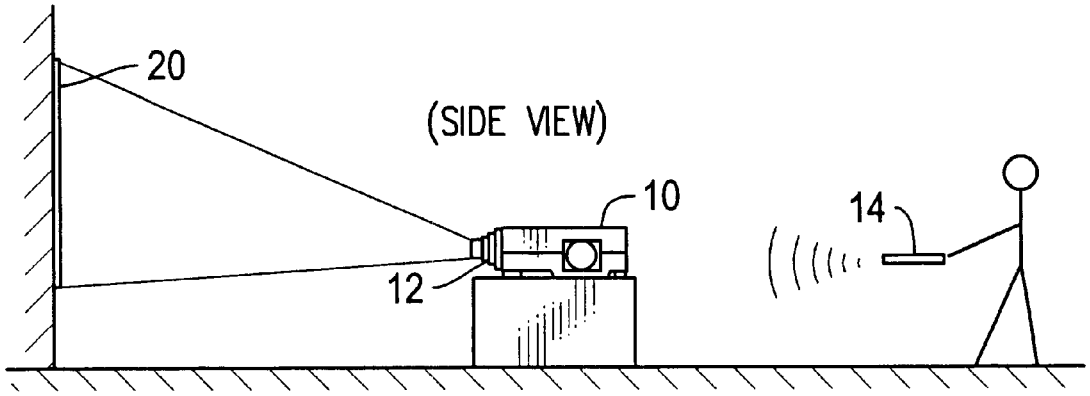
FIG. 1 is an explanatory diagram illustrating the state of use of a liquid crystal projector to which the present invention has been applied.

FIG. 1 illustrates a state in which a liquid crystal projector 10 is used as an image reproducing apparatus, a certain image being projected upon a screen 20 from the projecting opening 12 thereof.

Figure 2:
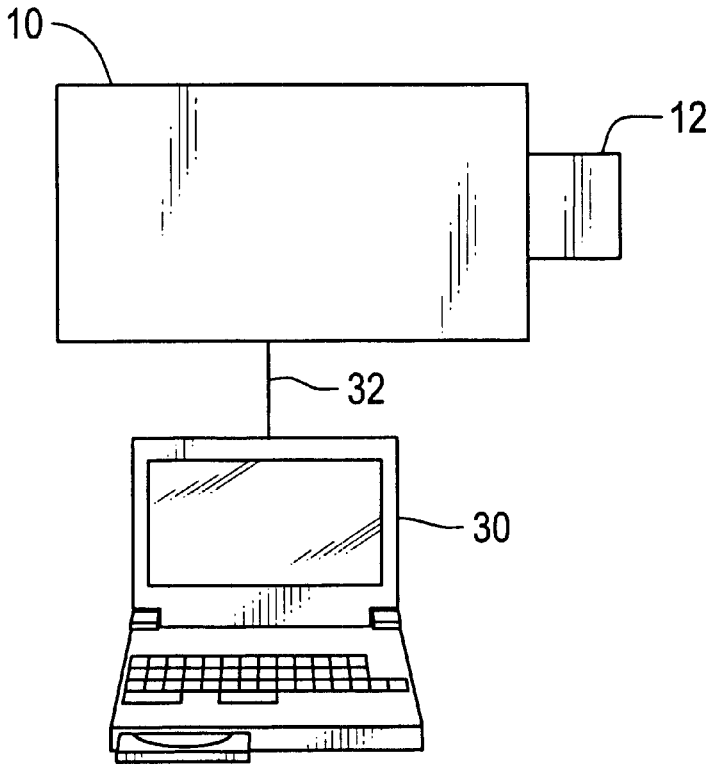
FIG. 2 is an explanatory diagram illustrating the state of connection of a liquid crystal projector in accordance with an embodiment of the present invention to a computer.

The aforementioned liquid crystal projector 10 is, as shown in FIG. 2, connected to a computer 30 for supplying analog image signals via a communication line 32, samples the input analog image signals according to each pixel of the liquid crystal shutter and displays a reproduced image on the screen 20 as a projector image.

Although the basic operations of the aforementioned liquid crystal projector 10 can be performed by operating various operating units provided in the main body of the projector. In the present embodiment, a remote controller 14 for the projector is used in addition to this, thus enabling remote control of the liquid crystal projector 10.

Figure 3:
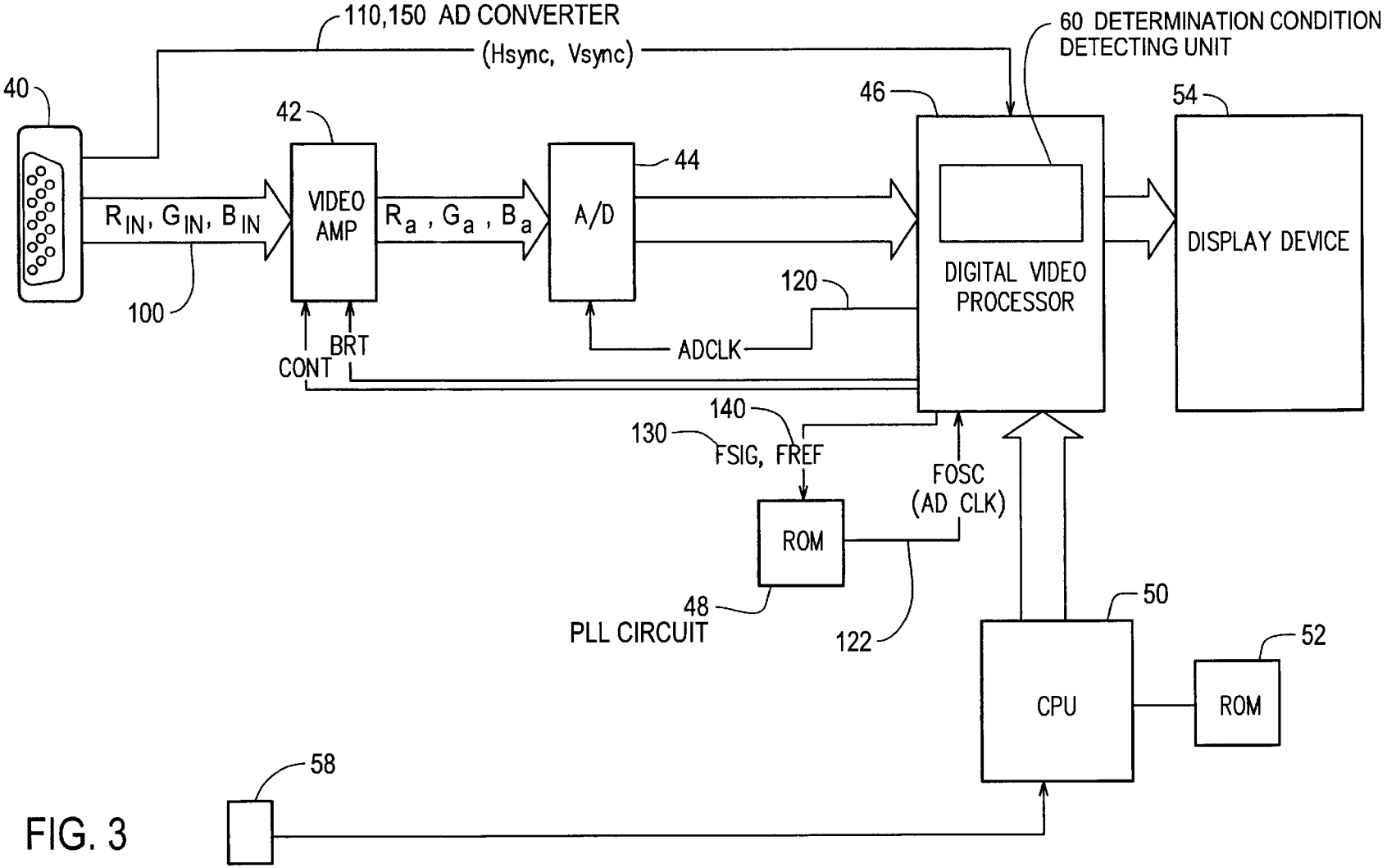
FIG. 3 is a functional block diagram of the liquid crystal projector in accordance with an embodiment of the present invention.
Figure 4:
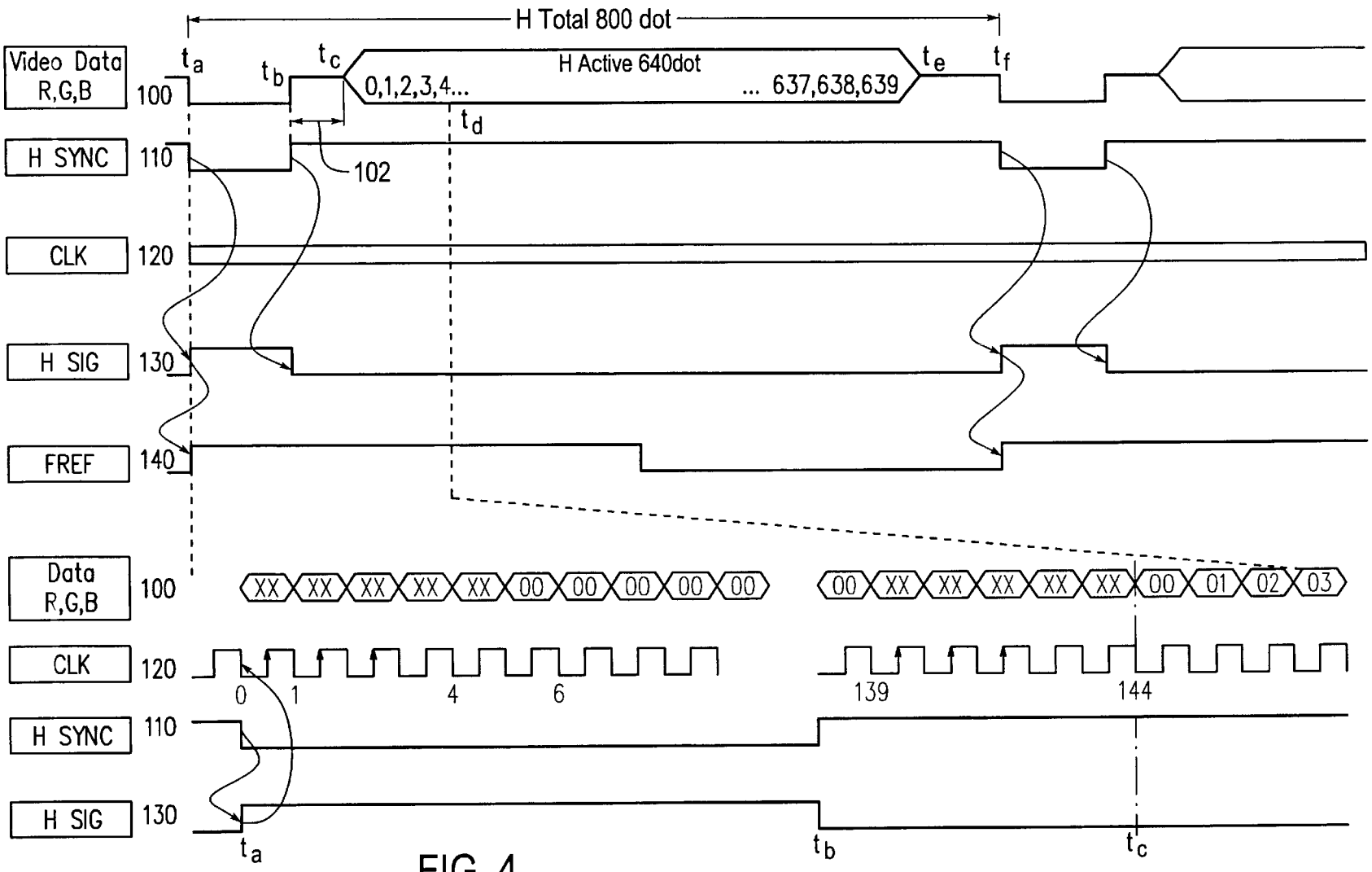
FIG. 4 is a timing chart of the functional block diagram shown in FIG. 3.

FIG. 3 shows a specific functional block diagram for the aforementioned liquid crystal projector 10. FIG. 4 shows the timing chart thereof. Incidentally, only the configurations necessary for image reproduction are shown in order to simplify the explanation. The circuits used for reproducing sound signals and circuits used for reproduction of sound signals and image signals from other video equipment are omitted.

The liquid crystal projector 10 according to the present embodiment is comprised of an input/output terminal 40, video amplifier 42, A/D converter 44, digital video processor 46, PLL circuit 48, CPU 50, memory 52, a display device 54, and an operating unit 58.

The aforementioned display device 54 is constructed so as to use three liquid crystal shutters, i.e., R, G, and B, to generate a color image from the R, G, and B digital image signals supplied from the digital video processor 46 to display on the screen 20.

In image generation using such a liquid crystal projector, there is a necessity to perform sampling of the input analog image signals according to the pixels of the liquid crystal projector.

Particularly, in the event that analog image signals are input to the projector 10 from a computer 30, to first accurately automatically determine the display mode of the analog image signals is crucial for performing sampling of the analog signals using optimal sampling parameters.

In order to conduct such auto-determination, the digital video processor 46 according to the present invention is provided with a determination condition detecting unit 60 for calculating the determination conditions of the display mode based on the horizontal synchronous signals 110 and the vertical synchronous signals 150 contained in the input analog image signals. Further, display mode determination data for determining the display mode of the input image signals based on the obtained determination conditions is stored within the aforementioned memory 52.

That is to say, with the liquid crystal projector 10 according to the present invention, the horizontal synchronous signals 110 and the vertical synchronous signals 150 in the input analog image signals input to the input terminal 40 from the computer 30 are input to the digital video processor 46, and three primary colors analog image signals 100 of R, G, and B are input to the video amplifier 42.

The aforementioned determination condition detecting unit 60 detects the horizontal scanning data, vertical scanning data, and synchronizing signal polarity data of the input analog image signals, based on the horizontal synchronous signals 110 and the vertical synchronous signals 150.

The aforementioned horizontal scanning data is time data from the output point ta of the horizontal synchronous signal to the output point tf of the next horizontal synchronous signal, as shown in FIG. 4.

Figure 6:
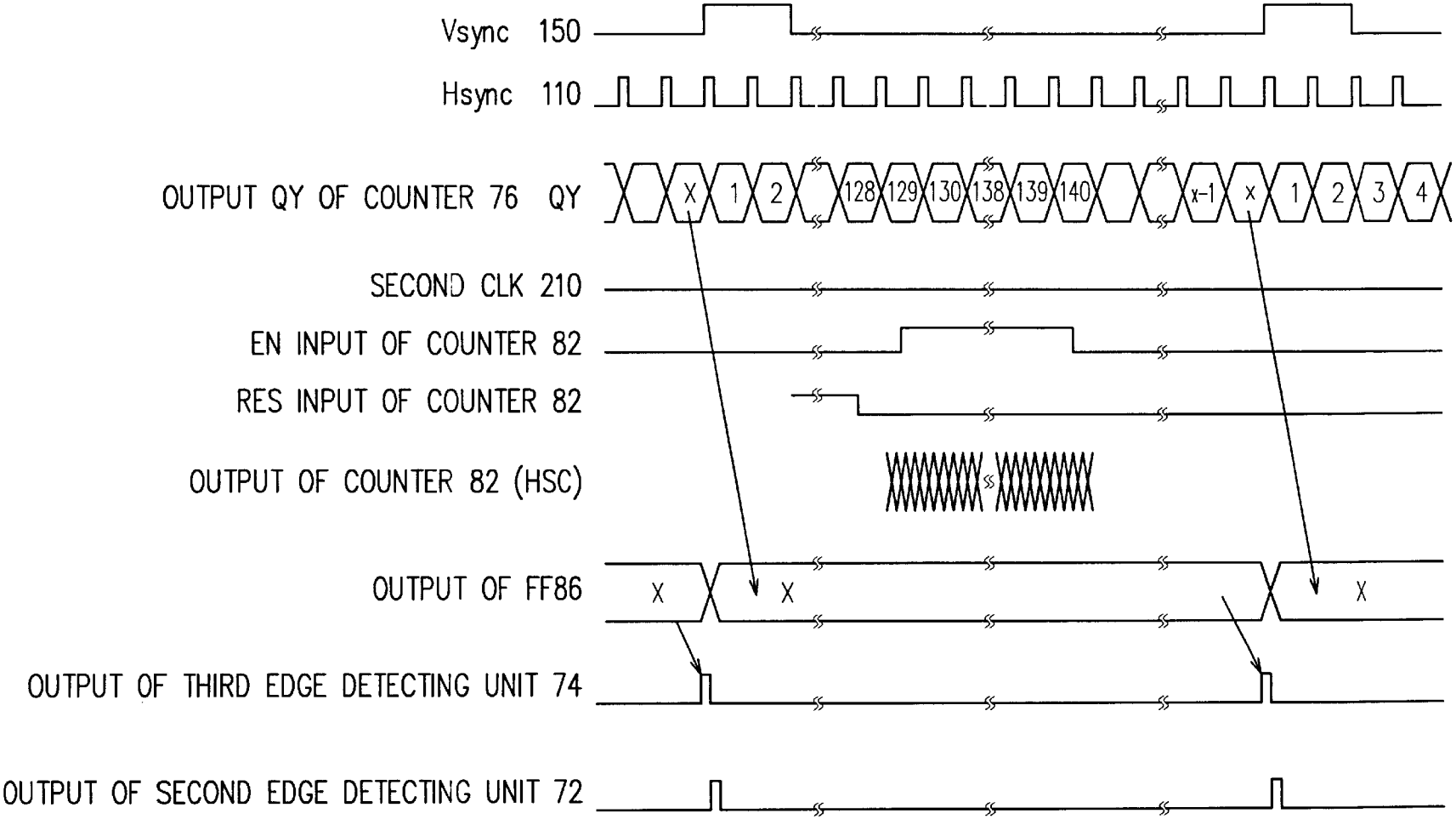
FIG. 6 is a timing chart for the determination condition detecting unit illustrated in FIG. 5.

The aforementioned vertical scanning data is time data from the output of the vertical synchronous signal 150 to output of the next vertical synchronous signal, as shown in FIG. 6. Here, this means the number of horizontal synchronous signals 110 output during that time, and specifically, this is the data representing how many horizontal scanning lines exist within a single vertical scanning period.

The aforementioned polarity data is data which represents the polarity, i.e., plus or minus, of the horizontal synchronous signals 110 and the vertical synchronous signals 150. According to the type of analog image signals, such synchronous signals may be of a positive value or may be of a negative value. In the later-described table in FIG. 9, a plus value is represented as "1", and a negative value as "0".

Here, plus polarity (positive polarity) means pulses of 5 volts at the time that there is no data, and 10 volts at the time of data input. Minus polarity (negative polarity) means pulses of 5 volts at the time that there is no data, and 0 volts at the time of data input.

The determination condition detecting unit 60 according to the present embodiment performs detection of such three types of data at the first stage in which analog image signals are input to the projector 10.

Figure 5:
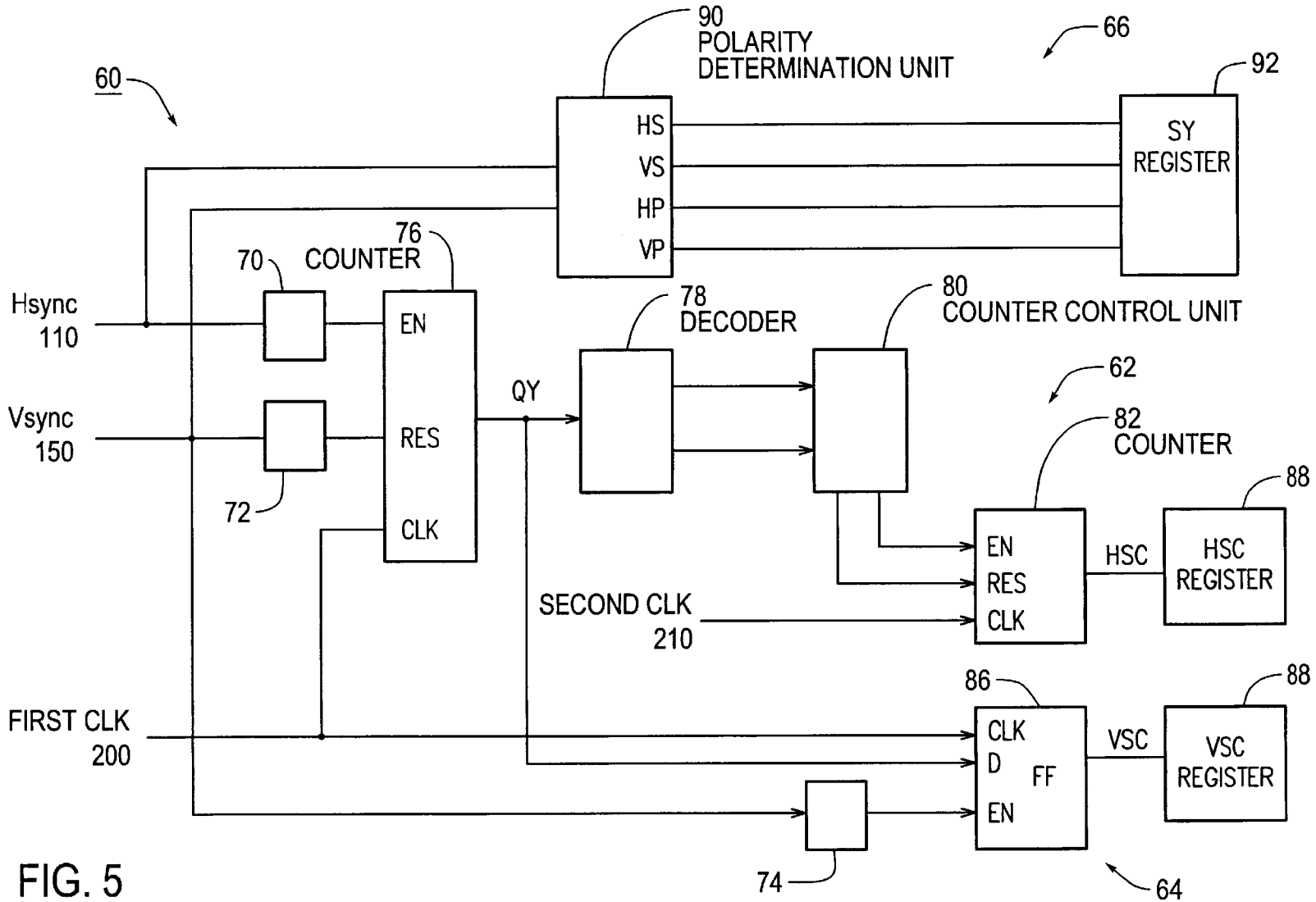
FIG. 5 is a functional block diagram of a determination condition detecting unit provided in the liquid crystal projector in accordance with an embodiment of the present invention.

FIG. 5 illustrates a specific function block diagram for the determination condition detecting unit 60.

In the figure, the first clock 200 is set to a frequency sufficiently greater than the frequency of the horizontal synchronous signals 110, and the second clock 210 is set to a frequency even greater than the frequency of the first clock 200. Both are generated within the digital video processor 46.

As shown in the figure, this determination condition detecting unit 60 is comprised of a first detecting unit 62 for detecting horizontal scanning data, a second detecting unit 64 for detecting horizontal scanning data, and a third detecting unit 66 for detecting polarity data of synchronous signals.

The first detecting unit 62 is comprised of a first edge detecting unit 70, a second edge detecting unit 72, a counter 76, a decoder 78, a counter control unit 80, a counter 82, and an HSC register 84.

The second detecting unit 64 is comprised of a third edge detecting unit 74, flip-flop 86, and a VSC register 88.

The third detecting unit 66 is comprised of a polarity detecting unit 90 and an SY register 92.

Now, at the point that horizontal synchronous signals 110 and the vertical synchronous signals 150 are input to this determination condition detecting unit 60, the first through third edge detecting units 70, 72, and 74 detect the rising portion of each of the synchronous signals and output detecting pulses. Output of the second and third edge detecting units 72 and 74 are shown in FIG. 6. Incidentally, the second edge detecting unit 72 is different from the other two edge detecting units 70 and 74 in that it outputs an edge detecting pulse which has been delayed by one pulse, in order to safely perform an intake of the value of the counter 76.

First, the operation of the first detecting unit 62 will be described.

At the point that a vertical synchronous signal 150 is output, the counter 76 is reset by means of the detecting output of the edge detecting unit 72. Next, the counter 76 is maintained in an enabled state by pulse signals output from the edge detecting unit 70 each time horizontal synchronous signals 110 are input, and the counter 76 counts the first clock pulses 200 being input.

The counter 76 is not reset except by input of vertical synchronous signals, so the count value thereof is sequentially accumulated from QY, and is output to the decoder 78 and flip-flop 86.

The counted value QY output at this point is output with a certain relation to the number of times of horizontal scanning. Here, a count value equivalent to one horizontal scanning is output within the first horizontal scanning period, and a count value equivalent to two horizontal scannings is output within the second horizontal scanning period.

The decoder 78 detects the point at which the horizontal scanning lines reach y=128 and y=129 lines, and the point at which the horizontal scanning lines reach y=139, and inputs the detected data to the counter control unit 80.

The counter control unit 80 resets the counter 82 at the point at which the horizontal scanning lines reach y=128, as shown in FIG. 6, and controls the counter 82 in an enabled state from the time that the horizontal scanning lines reach y=129 to the point at which the horizontal scanning lines reach y=139.

The counter 82 counts the second clock pulses 210 input to the CLK terminal during the enabled period, i.e., the period between y=129 to y=139, and latches the count value HSC to the HSC register 84 as data representing the total time of the horizontal scanning period for the 11 lines. The reason why the horizontal scanning period for the 11 lines is thus latched to the register 84 is that the margin of error can be lessened as compared to simply measuring the horizontal scanning period for a single line. Also, an arrangement for measuring the horizontal scanning period for 12 or more lines can be employed, or an arrangement for measuring the horizontal scanning period for 10 or less lines can be employed, as well.

Hence, the HSC data latched to the HSC register 84 is handled as horizontal scanning data representing horizontal scanning time.

Next, operation of the second detecting unit 64 will be described.

With the second detecting unit 64, the input of the vertical synchronous signals 150 is detected from the third edge detecting unit 74 and the flip-flop 86 is enabled at the point that the third edge detecting unit 74 outputs detecting signals. At this time, the flip-flop 86 latches the count value QY output from the counter 76, synchronously with the input of the first clock pulses 200. Accordingly, the QY latched by the flip-flop 86 sequentially increases as horizontal scanning is repeated.

Then, the VSC 88 latches the count value QY of the horizontal scanning lines counted by the counter 76 until immediately before one vertical scan is completed as vertical scanning data, i.e., during the period from a vertical synchronous signal 150 being output to output of the next vertical synchronous signal.

Next, operation of the third detecting unit 66 will be described.

The polarity detecting unit 90 performs polarity determination of both input synchronous signals 110 and 150, i.e., determination of whether the signals are positive or negative, and the determination results are latched to the SY register 92. This latched data is polarity data.

Next, description of the configuration in which determination of the display mode of the input analog image signals is made based on the horizontal scanning data, vertical scanning data, and polarity data detected by the aforementioned determination condition detecting unit 60, will be described in detail.

As described above, display mode determination data for determining the display mode of the input image signals based on the data detected by the aforementioned determination condition detecting unit 60 is stored within the memory 52.

The display mode determination data weights the plurality of display modes shown in FIG. 7 using the analog image signal's horizontal scanning data, vertical scanning data, and synchronizing signal polarity data, forming table data grouped as shown in FIG. 8A through FIG. 8D.

Now, FIG. 7 shows a list of display modes in which the liquid crystal projector 10 of the present embodiment can automatically determine, and is structured so as to automatically determine 14 types of display modes.

With the present embodiment, each of the display modes shown in FIG. 7 are first classified as table data of four groups as shown in FIGS. 8A through 8D, based on the value of vertical scanning data.

FIG. 8A shows a table of the group in which the vertical scanning data VSC is 320 or greater but less than 482, FIG. 8B shows a table of the group in which the vertical scanning data VSC is 482 or greater but less than 602, FIG. 8C shows a table of the group in which the vertical scanning data VSC is 602 or greater but less than 770, and FIG. 8D shows a table of the group in which the vertical scanning data VSC is 770 or greater but less than 832.

VSC and HSC values are set for each display mode in the data table for each group.

Further, with the present embodiment, even in the event that the display mode cannot be determined from the table shown in FIGS. 8A through 8D, a table showing the polarity data thereof for each display mode is prepared to finally determine the display mode, as shown in FIG. 9.

The CPU 50 makes reference to the table data shown in FIGS. 8A through 8D stored in the aforementioned memory 52 from the aforementioned horizontal scanning data, vertical scanning data, and polarity data being output from the determination condition detecting unit 60, and identifies an optimal display mode.

Figure 10:
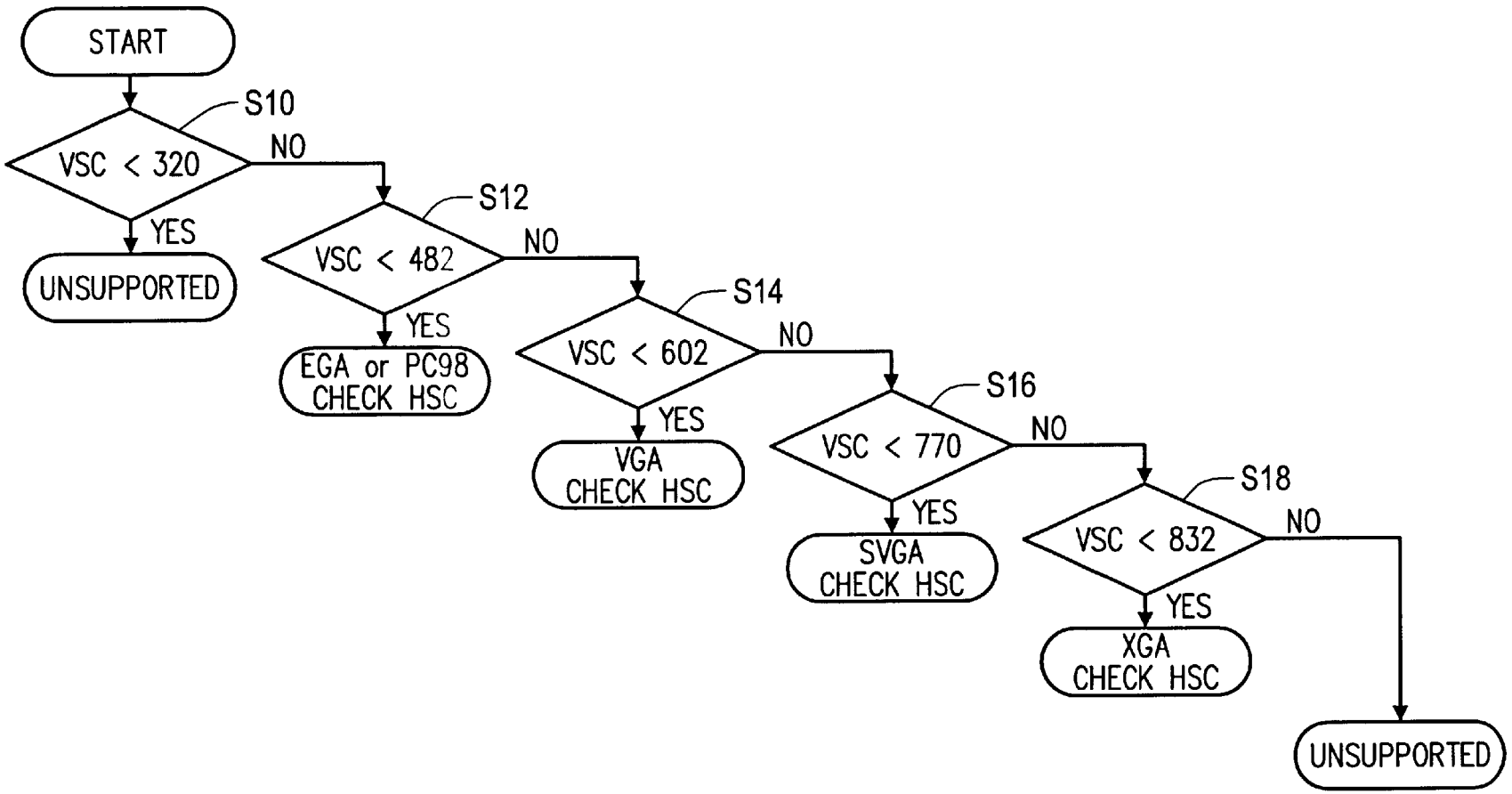
FIG. 10 is a flowchart illustrating an algorithm for determining the optimal display mode in the present embodiment.

FIG. 10 shows an algorithm to this end.

First, the CPU 50 performs a determination of which of the conditions in Step S10, Step S12, and so on through Step S18 are met by the value of the vertical scanning data VSC detected by the determination condition detecting unit 60.

Now, in the event that the value of VSC is determined to be less than 320 or 832 or greater in the determination operations in steps Sl0 through S18, a determination is made that these image signals are not supported by the liquid crystal projector 10 according to the present embodiment, and the image reproducing operation ends. Then, a message indicating that the input signals cannot be correctly displayed, e.g., "NON SUPPORTED" is displayed, informing the user that the projector is operating normally. Thus, in the event that the image cannot be displayed, the user can accurately tell whether the cause is due to malfunctioning of the projector or due to unsupported signals.

In this case, information about the input signals, e.g., vertical synchronous frequency, horizontal synchronous frequency, etc. may be displayed as necessary, giving the user an opportunity to consider countermeasures for the unsupported signals.

Also, in the event that the CPU 50 determines that the signals meet the conditions of the steps S12 through S18, one table corresponding thereto is identified from FIGS. 8A through 8D.

In the event that there is only one display mode within the group identified at this time, e.g., in the case shown in FIG. 8D, the display mode belonging to that group is determined to be the image signal display mode as such.

Also, in the event that there is a plurality of display modes within the group identified at this time, the CPU 50 then identifies the display mode in which the HSC matches, based on the horizontal scanning data HSC value detected by the determination condition detecting unit 60. Also, in the event that the detected HSC value does not completely match, such as in the case wherein the value is between two display mode HSC values, the two display modes are identified, and the polarity of these two display modes are checked based on the table shown in FIG. 9. Then, the display mode with the polarity matching the polarity data detected by the determination condition detecting unit 60 is finally identified as the display mode of the input image signals.

Thus, according to the present embodiment, one optimal display mode can be automatically determined in the end, based on the analog image signals input to the projector.

Moreover, the aforementioned memory 52 stores sampling parameters for performing sampling of analog image signals according to each display mode. The clock frequency of the later-described sampling clock pulses 120, the later-described back-porch value of the phase data, and vertical and horizontal position data are set as such sampling parameters.

Then, the CPU 50 reads the sampling parameters corresponding to the display mode selected as described above from the memory 52, and outputs control signals based on the sampling parameters to the digital video processor 46.

Accordingly, the digital video processor 46 uses the PLL circuit 48 to generate sampling clock pulses 120 having specified sampling frequency and phase, which is output to the AD converter 44, and also performs reproducing processing of the R, G, and B image signals with an optimal back-porch specified by the CPU 50, which is output to the display device 54 and displayed on the screen 20 as an image.

The following is a detailed description of the process of sampling the input analog image signals based on the display mode automatically determined as described above.

With the liquid crystal projector 10 according to the present embodiment, of the analog image signals input to the input/output terminal 40 from the computer 30, three primary colors analog image signals 100 of R, G, and B are output to the video amplifier 42.

The video amplifier 42 amplifies the three input primary colors analog image signals 100 based on the contrast and brightness control signals input from the digital video processor 46, and inputs these to the A/D converter 44.

The A/D converter 44 samples the input analog image signals synchronously with the sampling clock pulses 120 supplied from the digital video processor 46, and converts these into digital signals according to each pixel of the liquid crystal shutter and outputs them to the digital video processor 46.

Then, the digital video processor 46 performs reproducing processing of the R, G, and B image signals with optimal back-porch, based on the digital signals input from the A/D converter 44, outputs these signals to the display device 54, and displays these signals on the screen 20 as an image.

Next, the construction and operation of the circuitry of the present embodiment will be described with reference to the timing chart shown in FIG. 4.

As shown in FIG. 4, in the event that one scanning line of analog image signals is input, first the horizontal synchronous signals 110 are input, and then analog image signals 100 of R, G, and B are input. Here, pulses of the horizontal synchronous signal 110 are output during the period between ta and tb.

Then, analog image signals 100 for one horizontal scanning are output from the rising time of the horizontal synchronous signal 110 pulse at tb to the point tc at which a certain back-porch 102 time has elapsed. Here, analog image signals for 640 pixels is output.

The output of the analog image signals 100 ends at the timing of te, and the image output for one horizontal scanning is completed at the timing of tf.

FIG. 4 shows a timing chart for the input R, G, and B image signals being sampled by the A/D converter 44 based on the sampling clock pulses 120 and digitized.

According to the present embodiment shown in FIG. 4, the total time for one horizontal scanning from ta through tf is time for 800 dots (pixels), corresponding to the output cycle of each pixel. Accordingly, in order to accurately sample the digital signals from the analog image signals 100, 800 sampling clock pulses 120 need to be output between ta and tf.

FIG. 4 shows the output timing of these sampling clock pulses 120. As shown in the figure, the A/D converter 44 samples the analog image signals at the rising time of the sampling clock pulses, and converts to digital.

In the present embodiment, the optimal display mode is automatically determined as described above, and corresponding sampling parameters are automatically set. Accordingly, the sampling clock pulses 120 output from the digital video processor 46 to the A/D converter 44 is accurately generated in accordance with the output timing of the horizontal synchronous signals, and moreover, the phase thereof is adjusted so that sampling can be performed at optimal timing.

Accordingly, the input analog image signals can be accurately sampled, and good image reproduction can be realized.

Also, with the present embodiment, a PLL circuit 48 is used in order to generate such a sampling clock pulses 120. The digital video processor 46 generates horizontal signals 130 from the input horizontal synchronous signals 110 wherein the H and L levels are inverted, based on instruction from the CPU 50, and outputs these to the PLL circuit 48. Further, the digital video processor 46 outputs frequency reference signals FREF 140 to the PLL circuit 48, at an output cycle wherein the number of sampling clocks corresponding to one horizontal scanning cycle of 800 dots are output from the falling point ta of the horizontal synchronous signals 110. More specifically, the signal 140 is generated so as to be output at the timing of ta, and completes one cycle of output at the point that the digital video processor 46 counts 800 sampling pulses from the timing of ta.

The PLL circuit 48 uses both such input signals 130 and 140, and as shown in FIG. 4, sets the phase thereof so that the first output pulse is completely synchronized at the falling of the horizontal synchronizing signal 110 for outputting pulses 122 (see FIG. 3). That is, 800 pulses 122 are output between the timing of ta and the timing of tf.

When the pulse 122 is used as the sampling pulse 120 with no change, there often is slight offset in the sampling position of the analog image signal 100. Accordingly, the CPU reads sampling data relating to phase from the memory 52, causes the digital video processor 46 to adjust the phase of the pulse 122, and outputs this to the A/D converter 44 as sampling pulses 120.

According to the above configuration, the A/D converter 44 samples the input analog image signals at an accurate phase according to each pixel, and converts these signals into digital signals.

Now, the analog image signals output from the computer 30 are often such that the aforementioned back-porch 102 value is also slightly different depending on the manufacturer.

In this case as well, with the present embodiment, the digital video processor 46 is capable of performing reproducing processing of the R, G, and B image signals with an optimal back-porch, and is capable of good image reproduction from this perspective, as well.

Thus, according to the liquid crystal projector according to the present embodiment, the display mode of the analog image signals is first accurately automatically determined and the analog image signals are sampled using sampling parameters matching the display mode, thereby generating an image.

Particularly, with the liquid crystal projector according to the present embodiment, an optimal display mode can always be selected automatically from the input analog image signals, so problems such as those of the conventional art wherein the display mode cannot be determined and image reproduction is not performed can be avoided, and thereby an image reproducing apparatus which is extremely user-friendly can be achieved.

Moreover, even in the case that the display mode determined by the present invention does not completely agree with the actual display mode, image reproduction is conducted based on sampling parameters close to the accurate display mode. Accordingly, the user can easily set the various adjustments in an extremely easy manner by, for example, simply fine-tuning the tracking or phase, while observing the displayed image, thereby realizing an extremely handy liquid crystal projector in this aspect, as well.

FIG. 11 shows an example of determining a greater number of display modes than that of the above embodiment. Here, 25 types are set as determination objects of the display mode.

The present embodiment is characterized by an addition of tabled data of the SXGA group to the determination objects.

With the present embodiment, each of the display modes shown in FIG. 11 are first classified as table data of the following five groups, based on the value of vertical scanning data.

The display modes shown in FIG. 11 are: a table of the EGA/PC98 group in which the vertical scanning data VSC is 320 or greater but less than 482, a table of the VGA group in which the vertical scanning data VSC is 482 or greater but less than 602, a table of the SVGA group in which the vertical scanning data VSC is 602 or greater but less than 770, a table of the XGA group in which the vertical scanning data VSC is 770 or greater but less than 832, and a table of the SXGA group in which the vertical scanning data VSC is 832 or greater but less than 1150.

VSC and HSC values are set for each display mode in the table data for each group.

Further, with the present embodiment, even in the event that the display mode cannot be determined from the table shown in FIG. 11, a table showing the polarity data thereof for each display mode is prepared, as shown in FIG. 12, so that final determination of the display mode can be made.

The display mode determination data shown in FIGS. 11 and 12 are stored in the memory 52, as with the above embodiment.

The CPU 50 specifies an optimal display mode based upon the aforementioned horizontal scanning data, vertical scanning data, and polarity data which are output from the determination condition detecting unit 60, and the data tables shown in FIGS. 11 and 12, stored in the memory 52.

Figure 13:
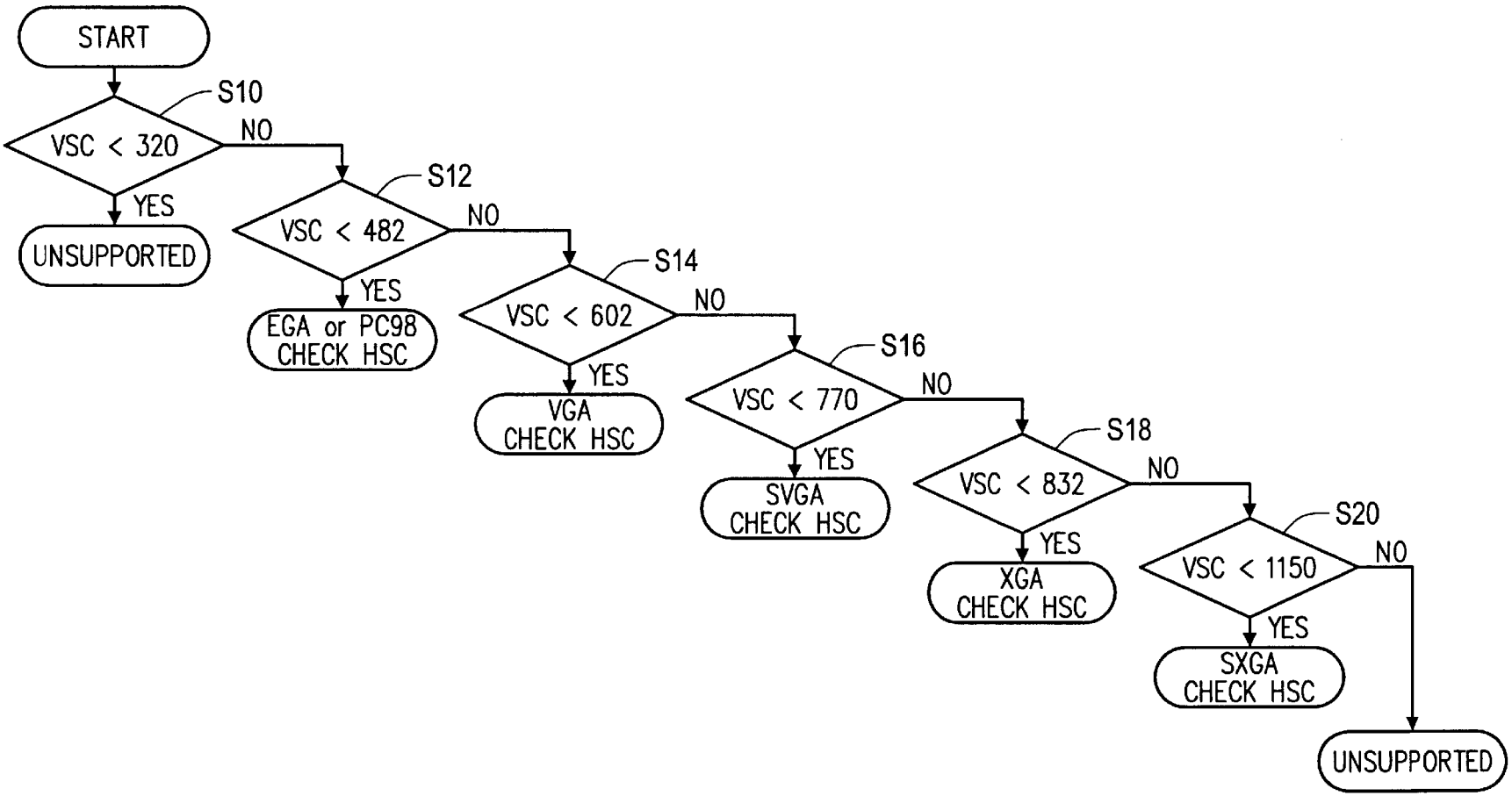
FIG. 13 is a flowchart illustrating an algorithm for determining the optimal display mode from the display modes shown in FIGS. 11 and 12.

FIG. 13 shows an algorithm to this end. The steps here which correspond to the algorithm in FIG. 10 are provided with the same reference numeral, and description thereof is omitted.

With the present embodiment, in step S20, in the event that the VSC value is determined to be 832 or greater but less than 1150, the table corresponding to the SXGA group shown in FIG. 11 is selected. Then, the optimal display mode is identified from the display modes belonging to this group. Other operations are basically the same as those of the above embodiment, so description thereof will be omitted here.

The above embodiment allows the optimal display mode to be automatically identified from a greater number of display modes.

Also, with the present embodiment, an information storing medium can be integrally built-in with the memory within the hardware of the liquid crystal projector 10, so as to execute the above-described display mode determination completely in the form of data and programs. The information storing medium is an information storing medium for an image reproducing apparatus which samples and reproduces input analog image signals in accordance with display pixels and including: information for automatically determining a display mode from the analog image signals; and information for sampling and generating image data. Sampling parameters for sampling and reproducing input analog image signals in accordance with display pixels are set for each display mode, and the input analog image signals are scanned and image data is reproduced in accordance with display pixels, based on the sampling parameters corresponding with the judged display mode. The information for automatically determining comprises: information for determining data which has been formed by weighting and grouping each display mode using the horizontal scanning data of the analog image signals, the vertical scanning data of the analog image signals, and polarity data of the synchronous signals; information for detecting the input horizontal scanning data and vertical scanning data of the analog image signals, and polarity data of the synchronous signals; and information for determining the display mode of the analog image signals input from the grouped determination data, using at least one of the detected horizontal scanning data of the analog image signals, vertical scanning data of the analog image signals, and synchronous signals.

In this case, the configuration may be such that part of this information is stored in the form of an external storing medium and this external storing medium is mounted to the liquid crystal projector to be used.

Also, while the above embodiments have been described with reference to an example wherein the present invention is applied to a liquid crystal projector, the present invention is by no means restricted to such an arrangement, and can be used in a wide variety of applications to image reproducing apparatus wherein input analog image signals are sampled according to display pixels and displayed, such as image reproducing apparatuses which use displays such as liquid crystal displays, plasma displays, and the like.

Also, while the above embodiments have been described with reference to an example wherein the present invention digitizes and reproduces the sampling data, the present invention is by no means restricted to such, and the sampled analog data may be used for display on each pixel of the image reproducing apparatus as such. For example, the arrangement may be such wherein the voltage of the sampled analog data is applied to the liquid crystal cell, thereby reproducing each pixel.

What is claimed is:

1. An image reproducing apparatus which samples and reproduces input image signals in accordance with display pixels, said image reproducing apparatus comprising:

storing means for storing determination data formed by weighting and grouping a plurality of display modes using horizontal scanning data of the image signals, vertical scanning data of the image signals, and polarity data of synchronous signals;

a determination condition detecting unit that detects said horizontal scanning data and vertical scanning data of the input image signals, and the polarity data of the synchronous signals;

determination means for determining the display mode, from the plurality of display modes, of said image signals input from said determination data, using at least one of said detected horizontal scanning data and vertical scanning data of the image signals, and the polarity data of the synchronous signals; and image data generating means, sampling parameters for sampling and reproducing input image signals in accordance with display pixels being set for each display mode, and said image data generating mans sampling said image signals in accordance with display pixels based on the sampling parameters corresponding to the determined display mode.

2. An image reproducing apparatus according to claim 1, said determination data for said display mode being formed by weighting and grouping in an order of:

one of the horizontal scanning data and the vertical scanning data;

another of the horizontal scanning data and the vertical scanning data; and said polarity data.

3. An image reproducing apparatus according to claim 2, said determination data for said display mode being formed by weighting and grouping in an order of:

the vertical scanning data;

the horizontal scanning data; and said polarity data.

4. An image reproducing apparatus according to claim 1, said sampling parameters including a timing control sampling parameter for determining a timing for performing sampling of input analog image signals according to display pixels.

5. An image reproducing apparatus according to claim 1, said image data generating means for sampling input analog image signals according to said display pixels of a liquid crystal display, liquid crystal shutter or plasma display, based on said sampling parameters.

6. A liquid crystal projector which samples input analog image signals according to said display pixels of a liquid crystal shutter based on said sampling parameters and reproduces the input analog image signals as a projector image, using an image reproducing apparatus according to claim 1.

7. An image reproducing system, comprising:

a computer device for outputting image signals; and an image reproducing apparatus that samples and reproduces input image signals in accordance with display pixels, said image reproducing apparatus comprising:

storing means for storing determination data formed by weighting and grouping a plurality of display modes using horizontal scanning data of the image signals, vertical scanning data of the image signals, and polarity data of synchronous signals, a determination condition detecting unit that detects said horizontal scanning data and vertical scanning data of the input image signals, and the polarity data of the synchronous signals;

determination means for determining the display mode, from the plurality of display modes, of said image signals input from said determination data, using at least one of said detected horizontal scanning data and vertical scanning data of the image signals, and the polarity data of the synchronous signals; and image data generating means, sampling parameters for sampling and reproducing input image signals in accordance with display pixels being set for each display mode, and said image data generating means sampling said image signals in accordance with display pixels based on the sampling parameters corresponding to the determined display mode.

8. An information storing medium for an image reproducing apparatus which samples and reproduces input image signals in accordance with display pixels, said information storing medium including:

instructions for determining data formed by weighting and grouping a plurality of display modes using horizontal scanning data of the image signals, vertical scanning data of the image signals, and polarity data of synchronous signals;

instructions for detecting said horizontal scanning data and vertical scanning data of the image signals, and the polarity data of the synchronous signals;

instructions for determining the display mode, from the plurality of display modes, of said image signals input from said determination data, using at least one of said detected horizontal scanning data of the image signals, vertical scaning data of the image signals, and the polarity data of the synchronous signals; and instructions for sampling and generating image data, sampling parameters for sampling and reproducing the image signals in accordance with display pixels being set for each display mode, and said image signals being scanned and image data being reproduced in accordance with display pixels, based on the sampling parameters corresponding with the determined display mode.

9. An information storing medium according to claim 8, said determination data for said display mode being formed by weighting and grouping in an order of:

one of the horizontal scanning data and the vertical scanning data;

another of the horizontal scanning data and vertical scanning data; and said polarity data.

10. An information storing medium according to claim 9, said determination data for said display mode being formed by weighting and grouping in an order of:

the vertical scanning data;

the horizontal scanning data; and said polarity data.

11. An image reproducing system according to claim 7, said determination data for said display mode being formed by weighting and grouping in an order of:

one of the horizontal scanning data and the vertical scanning data;

another of the horizontal scanning data and the vertical scanning data; and said polarity data.

12. An image reproducing system according to claim 11, said determination data for said display mode being formed by weighting and grouping in an order of:

the vertical scanning data;

the horizontal scanning data; and said polarity data.

13. An image reproducing system according to claim 7, said sampling parameters including a timing control sampling parameter for determining a timing for performing sampling of input analog image signals according to display pixels.

14. An image reproducing system according to claim 7, said image data generating means sampling input analog image signals according to said display pixels of a liquid crystal display, liquid crystal shutter or plasma display, based on said sampling parameters.

15. An image reproducing method for sampling and reproducing input image signals in accordance with display pixels, said image reproducing method comprising:

storing determination data formed by weighting and grouping a plurality of display modes using horizontal scanning data of the image signals, vertical scanning data of the image signals, and polarity data of synchronous signals;

detecting said horizontal scanning data and vertical scanning data of the input image signals, and the polarity data of the synchronous signals;

determination the display mode, from the plurality of display modes, of said image signals input from said determination data, using at least one of said detected horizontal scanning data and vertical scanning data of the image signals, and the polarity data of the synchronous signals; and generating image data, sampling parameters for sampling and reproducing input image signals in accordance with display pixels being set for each display mode, and said image data generating step sampling said image signals in accordance with display pixels based on the sampling parameters corresponding to the determined display mode.

16. An image reproducing method according to claim 15, said determination data for said display mode being formed by weighting and grouping in an order of:

one of the horizontal scanning data and the vertical scanning data;

another of the horizontal scanning data and the vertical scanning data; and said polarity data.

17. An image reproducing method according to claim 16, said determination data for said display mode being formed by weighting and grouping in an order of:

the vertical scanning data;

the horizontal scanning data; and said polarity data.

18. An image reproducing method according to claim 15, said sampling parameters including a timing control sampling parameter for determining a timing for performing sampling of input analog image signals according to display pixels.

19. An image reproducing method according to claim 15, said image data generating step including inputting analog image signals according to said display pixels of a liquid crystal display, liquid crystal shutter or plasma display, based on said sampling parameters.

20. An image reproducing method, comprising:

outputting image signals;

storing determination data formed by weighting and grouping a plurality of display modes using horizontal scanning data of the image signals, vertical scanning data of the image signals, and polarity data of synchronous signals;

detecting said horizontal scanning data and vertical scanning data of the input image signals, and the polarity data of the synchronous signals;

determinaton the display mode, from the plurality of display modes, of said image signals input from said determination data, using at least one of said detected horizontal scanning data and vertical scanning data of the image signals, and the polarity data of the synchronous signals; and generating image data, sampling parameters for sampling and reproducing input image signals in accordance with display pixels being set for each display mode, and said image data generating step sampling said image signals in accordance with display pixels based on the sampling parameters corresponding to the determined display mode.

21. An image reproducing apparatus, comprising:

storing means for storing data formed by grouping a plurality of display modes based on at least one of horizontal scanning data, vertical scanning data and polarity data of synchronous signals associated with respective display modes;

a determination condition detecting unit that detects horizontal scanning data, and vertical scanning data and polarity data of synchronous signals corresponding to input image signals;

determination means for determining a display mode, from the plurality of display modes, of the input image signals based on the data, using at least one of the horizontal scanning data, the vertical scanning data, and the polarity data of the synchronous signals corresponding to the input image signals; and image data generation means for sampling the input image signals in accordance with display pixels based on sampling parameters corresponding to the determined display mode.

22. An image reproducing apparatus according to claim 21, each of the display modes being defined by a respective set of horizontal scanning time, horizontal scanning lines within a predetermined time period and polarity of the synchronous signals.

23. A projector comprising an image reproducing apparatus according to claim 21.

* * * * *